US007530199B2

(12) United States Patent
Yokomori et al.

(10) Patent No.: US 7,530,199 B2
(45) Date of Patent: May 12, 2009

(54) METHOD FOR CONTROLLING SLIDING SPEED OF VEHICLE SLIDE DOOR

(75) Inventors: Kazuhito Yokomori, Yamanashi-ken (JP); Takuya Imai, Yamanashi-ken (JP)

(73) Assignee: Mitsui Mining and Smelting Co., Ltd., Tokyo (JP)

( * ) Notice: Subject to any disclaimer, the term of this patent is extended or adjusted under 35 U.S.C. 154(b) by 443 days.

(21) Appl. No.: 11/085,237

(22) Filed: Mar. 22, 2005

(65) Prior Publication Data

US 2006/0112643 A1 Jun. 1, 2006

(30) Foreign Application Priority Data

Mar. 22, 2004 (JP) ..... 2004-083667
Mar. 23, 2004 (JP) ..... 2004-084045

(51) Int. Cl.
*E06B 3/00* (2006.01)

(52) U.S. Cl. ..... 49/506

(58) Field of Classification Search ..... 49/138, 49/279, 360, 506; 318/268, 271, 276, 434, 318/461, 465
See application file for complete search history.

(56) References Cited

U.S. PATENT DOCUMENTS 5,076,016 A * 12/1991 Adams et al. ..... 49/360
6,009,671 A * 1/2000 Sasaki et al. ..... 49/352
6,134,836 A * 10/2000 Kawanobe et al. ..... 49/360
6,199,322 B1 * 3/2001 Itami et al. ..... 49/139
6,425,206 B1 * 7/2002 Noda et al. ..... 49/360
6,580,243 B2 * 6/2003 Itami et al. ..... 318/452
6,799,669 B2 * 10/2004 Fukumura et al. ..... 192/105 R
6,877,280 B2 * 4/2005 Yokomori ..... 49/506
7,309,971 B2 * 12/2007 Honma et al. ..... 318/466
7,402,971 B2 * 7/2008 Averitt ..... 318/466
7,422,094 B2 * 9/2008 Yokomori ..... 192/84.7
2004/0103585 A1 * 6/2004 Yokomori ..... 49/360
2004/0123525 A1 * 7/2004 Suzuki et al. ..... 49/360
2004/0189046 A1 * 9/2004 Kawanobe et al. ..... 296/155
2005/0150167 A1 * 7/2005 Yokomori ..... 49/360
2005/0161973 A1 * 7/2005 Yokomori ..... 296/155
2005/0179409 A1 * 8/2005 Honma et al. ..... 318/62
2006/0022628 A1 * 2/2006 Okumatsu et al. ..... 318/437
2006/0112643 A1 * 6/2006 Yokomori et al. ..... 49/360
2006/0137136 A1 * 6/2006 Imai et al. ..... 16/52
2006/0150515 A1 * 7/2006 Shiga ..... 49/360
2006/0225358 A1 * 10/2006 Haag et al. ..... 49/360
2007/0163857 A1 * 7/2007 Yokomori ..... 192/215
2007/0201843 A1 * 8/2007 Takahashi ..... 388/806
2008/0000161 A1 * 1/2008 Nagai et al. ..... 49/360
2008/0061720 A1 * 3/2008 Takahashi ..... 318/286
2008/0178422 A1 * 7/2008 Imai et al. ..... 16/57

* cited by examiner

*Primary Examiner*—Jerry Redman
(74) *Attorney, Agent, or Firm*—Browdy and Neimark, P.L.L.C.

(57) ABSTRACT

Under a method to control a sliding speed in accordance with this invention, the motor is initially accelerated for a predetermined reference speed, and then during the initial acceleration period, if a rotational speed of the wire drum is of and above a given value, a difference between a rotational speed of the wire drum and a rotational speed of the motor is of and above a given value, and a rate of acceleration of the wire drum is of and above a given value, the rotational speed of the motor is reduced temporarily judging the slide door is in a state of abnormal acceleration, and then the motor is accelerated again at a lower rate than the initial acceleration toward the reference speed.

6 Claims, 7 Drawing Sheets

METHOD FOR CONTROLLING SLIDING SPEED OF VEHICLE SLIDE DOOR

FIELD OF THE INVENTION

This invention relates to a method to control a speed of a vehicle slide door configured to be slidably moved by a power slide device.

DESCRIPTION OF THE RELATED ART

Various types of power slide devices having a motor, a wire drum to be rotated by the motor for winding and paying out a wire cable, and a clutch mechanism disposed between the motor and the wire drum, and are constructed so as to cause a vehicle slide door slide toward an opening direction or a closing direction through rotating the wire drum have been proposed so far.

The sliding speed of a door slidingly moved by the power slide device is feedback controlled for matching it with a predetermined reference speed. For example, when the sliding speed is "80" against a reference speed of "100" the door is accelerated and when the sliding speed is "120" against the reference speed of "100" the door is decelerated.

Under such conventional feedback control, a "motor speed" obtained based on a rotational speed of the motor or a "drum speed" obtained based on a rotational speed of the wire drum has been utilized as a sliding speed of the slide door.

A motor speed or a drum speed are not always the same with an actual speed of the slide door (door speed, hereinafter). It is common to assume that the drum speed corresponds to that of the door, however, as the slide door can move independently with respect to the wire drum due to the effect of a tension mechanism for the wire cable, the door speed may be faster or slower than the drum speed. Similarly, as the motor moves the slide door by way of the wire drum, the door speed of the slide door varies recording a faster speed or slower speed than that of the motor due to similar reasons. In addition, as the clutch mechanism is interposed between the motor and the wire drum, a difference between the motor speed and the door speed may be amplified further depending on looseness present in the clutch mechanism. A factor which effects such difference between the motor speed or the drum speed and the door speed will be called as "connection looseness", hereinafter.

FIG. 22 shows a result of measurements of a motor speed and a door speed of a slide door when the slide door was opened through feedback control based on the motor speed in a nose-up inclined state of the vehicle. When a motor was accelerated toward a reference speed the door speed also was accelerated. In this case, however, the door speed was faster than the motor speed. This result indicates that the slide door accelerated its speed preceding acceleration of the motor because of an external force toward a direction of acceleration due to the nose-up inclined state acted on the slide door through the connection looseness.

After the motor speed reached the reference speed the motor was kept at a constant aped to match the reference speed, however, the slide door continuously increased its speed by a rate corresponding to the connection looseness and then turned to reduce its speed due to a braking effect of the motor brought about by the removal of the connection looseness. At the same time, as the connection looseness had been absorbed the motor advanced its speed because of a pulling effected by the slide door. When such acceleration in the motor speed was detected, the motor speed was reduced in accordance with the feedback control. In that case, however, the speed difference resulting from the connection looseness brought about repeated acceleration and deceleration of the motor speed recording alternately large ridges and troughs in the door speed.

Such a repetition of large ridges and troughs in the door speed appears larger number of times and lasts longer proportionately to the speed difference between the door speed and the motor speed effected when the motor speed is accelerated toward the reference speed. In other words, as no preceding acceleration of the door speed resulting from the connection looseness occurs in opening the door of a vehicle placed in a nose-down inclined state where an external force acts to decelerate the slide door, the variation in the door speed may be confined within a negligible range resulting in a smooth and stable movement of the slide door.

Such undesirable change in the door speed as shown in FIG. 22 is possible to be suppressed through effective control of the motor speed (and drum speed). In this case, accurate measurements of the motor speed (and drum speed) become an important factor to implement appropriate control over the door speed. However, under the conventional PWM (pulse width modulation) control and the DUTY control the motor speed has been measured by detecting motor pulses, and its accuracy has been inadequate to restrain the undesirable variation shown in FIG. 22.

SUMMARY OF THE INVENTION

Therefore, the object of this invention is to provide a method to restrain such a difference between the door speed and the motor speed as observed in accelerating the motor speed and to move the slide door smoothly at a stable speed.

Furthermore, the object of this invention is to provide a power slide device constructed into a rational structure comprising a mechanism to detect an actual rotational speed of the motor and also a mechanism to detect an actual rotational speed of the wire drum.

DESCRIPTION OF THE PREFERRED EMBODIMENT

Figure 1:
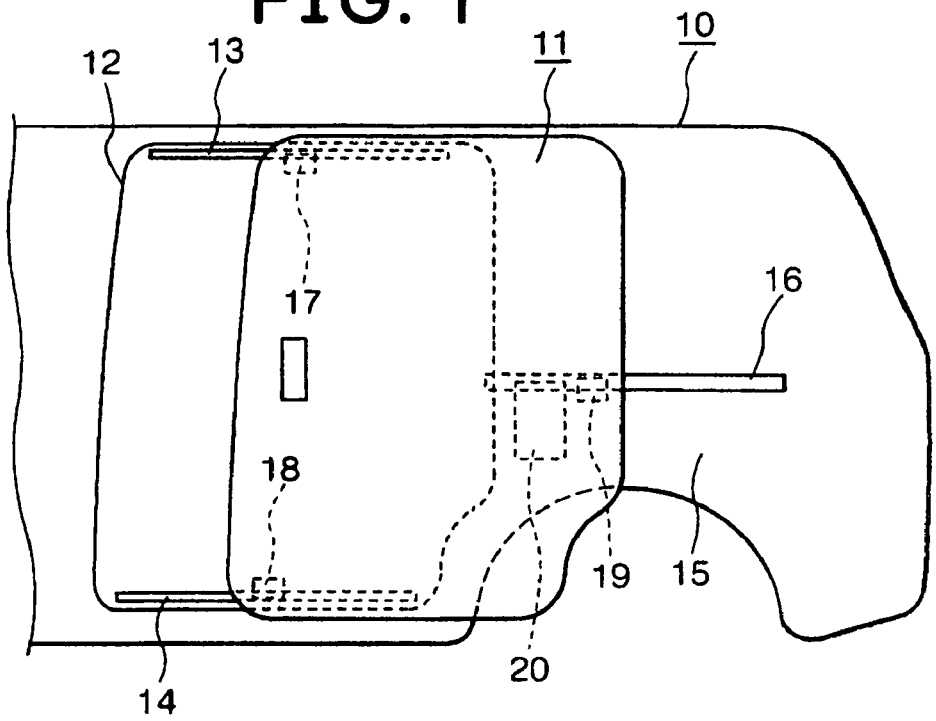
FIG. 1 is a side view showing a rearward side face of a vehicle equipped with a slide door.
Figure 2:
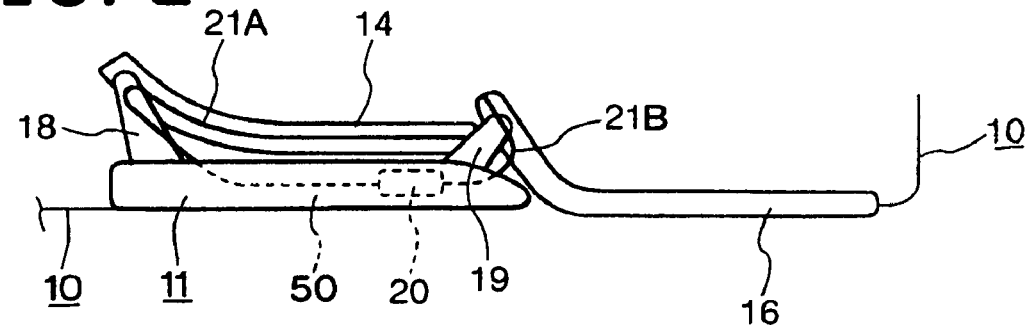
FIG. 2 is a view showing the relationship between the slide door and the vehicle body, in which the slide door closed.
Figure 3:
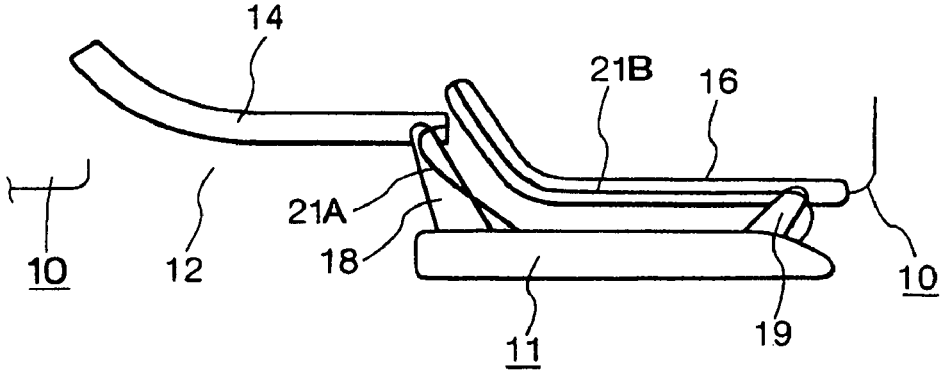
FIG. 3 is a view showing the relationship between the slide door and the vehicle body, in which the slide door opened.

Embodiment of the present invention will be described with reference to the drawings. FIGS. 1 to 3 shows a vehicle body 10, a slide door 11 slidably attached to the vehicle body 10, and a door aperture 12 which can be closed by the sliding door 11. The vehicle 10 in the vicinity of the upper portion of the door aperture 12 is fixed with an upper rail 13, and the vehicle body 10 in the vicinity of the lower portion of the door aperture 12 is fixed with a lower rail 14. @A quarter panel 15 which is a rear side surface of the vehicle body 10 is fixed with a center rail 16. The slide door 11 is provided with an upper roller bracket 17 slidably engaged with the upper rail 13, a lower roller bracket 18 slidably engaged with the lower rail 14, and a center roller bracket 19 slidably engaged with the center rail 16. Each of the roller brackets 17, 18 and 19 is suitably swingably journaled to the slide door 11.

A power unit 20 of the power slide device in accordance with this invention may be arranged in an inner space 50 (FIG. 2) of the slide door 11 or in an interior space of the quarter panel 15. However, the location of the power unit 20 is irrelevant to the essence of this invention.

The power unit 20, as shown in 5 through 7, is provided with a wire drum 30 for winding and paying out wire cables, and the wire drum 30 is connected with base ends of two wire cables, that is, a door-opening cable 21A and a door-closing cable 21B. When the wire drum 30 rotates in a door-opening direction, the door-opening cable 21A is wound up, and the door-closing cable 21B is paid out, and when the wire drum 30 rotates in a door-closing direction, the door-opening cable 21A is paid out, and the door-closing cable 21B is wound up.

The opening cable 21A is pulled out from a front lower position of the slide door 11, namely the vicinity of the lower bracket 18, toward a vehicle body side (on the side of the lower bracket 18) out of the slide door 11 as shown in FIGS. 2, 3. The opening cable 21A pulled out from the slide door 11 is extended backward inside the lower rail 14 after passing on a pulley (not shown) of the lower bracket 18, and is then fixed to the rear end portion of the lower rail 14 or the vehicle body 10 in the vicinity of the rear end portion of the lower rail. With this arrangement, when the opening cable 21A is wound under the door-closed state the slide door 11 slides rearward (toward the door-opening direction) by way of lower bracket 18.

The closing cable 21B is pulled out from a rearward, middle height position of the slide door 11, namely the vicinity of the center bracket 19 toward a vehicle body side (on the side of the center bracket 19) out of the slide door 11. The closing cable 21B pulled out from the slide door 11 is extended frontward inside the center rail 16 after passing on a pulley (not shown) of the center bracket 19, and is then fixed to the front side of the center rail 16 or the vehicle body 10 in the vicinity of the front side portion of the center rail. With this arrangement, when the closing cable 21B is wound under a door-open state the slide door 11 slides forward (toward the door-closing direction) by way of the center bracket 19.

Figure 4:
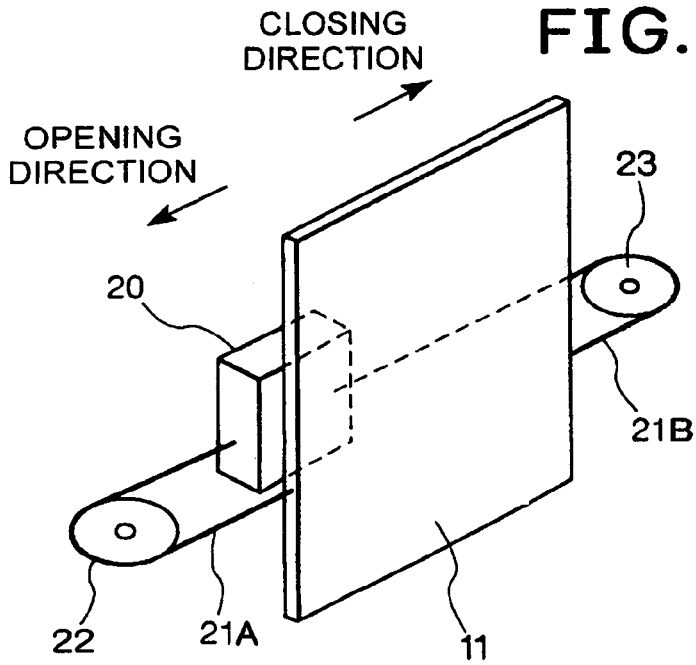
FIG. 4 is a conceptual view showing a case where a power unit is to be installed within an interior space of a quarter panel.

In case where the power unit 20 is installed in the interior space of the quarter panel 15, the free end of the opening cable 21A is connected to the center bracket 19 of the slide door 11 by way of a front pulley 22 pivoted at the front part of the center rail 16 as shown in FIG. 4, and similarly the free end of the closing cable 21B is connected to the center bracket 19 by way of a rear pulley 23 pivoted at the rear part of the center rail 16.

Figure 8:
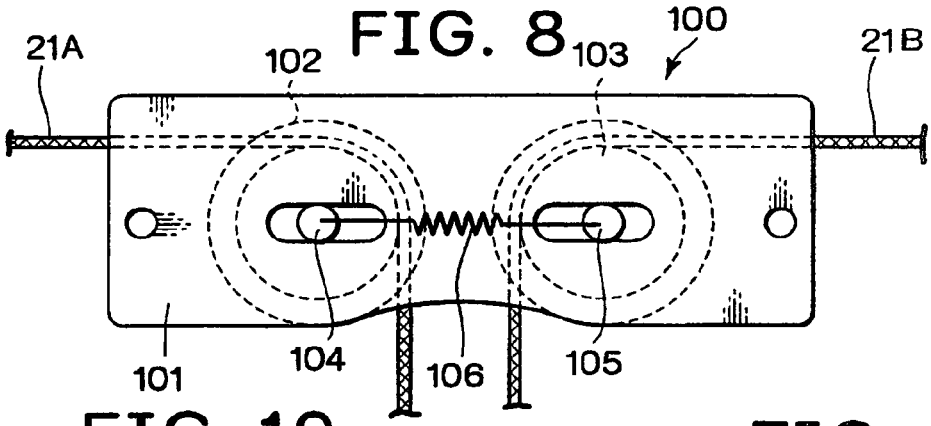
FIG. 8 is a plan view of a tension mechanism of the power unit.

FIG. 8 shows a tension mechanism 100 to maintain tension of the wire cable 30 at an appropriate level, the tension mechanism 100 being preferable to be installed inside the power unit 20. Within a case 101 of the tension mechanism 100 a pair of tension rollers 102, 103 on which the cables 21A, 21B abut are provided. The tension rollers 102, 103 are pivoted by tension shafts 104, 105 and are biased so as to draw each other by elasticity of a tension spring 106.

Figure 5:
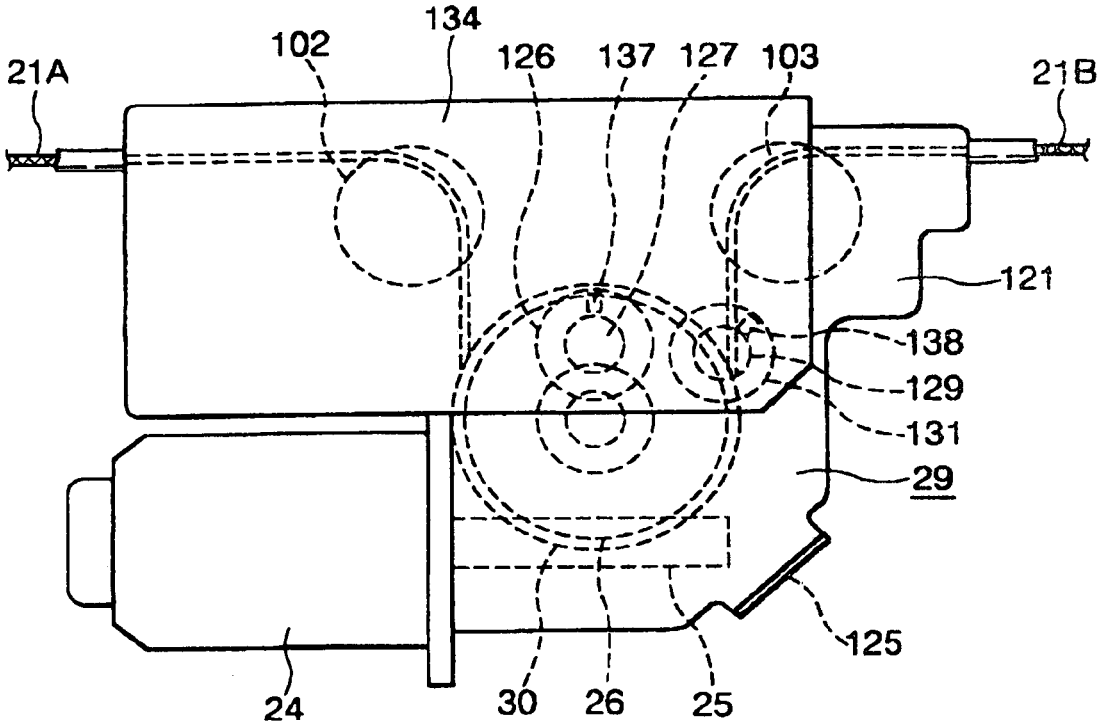
FIG. 5 is a side view of the power unit for the slide door.
Figure 6:
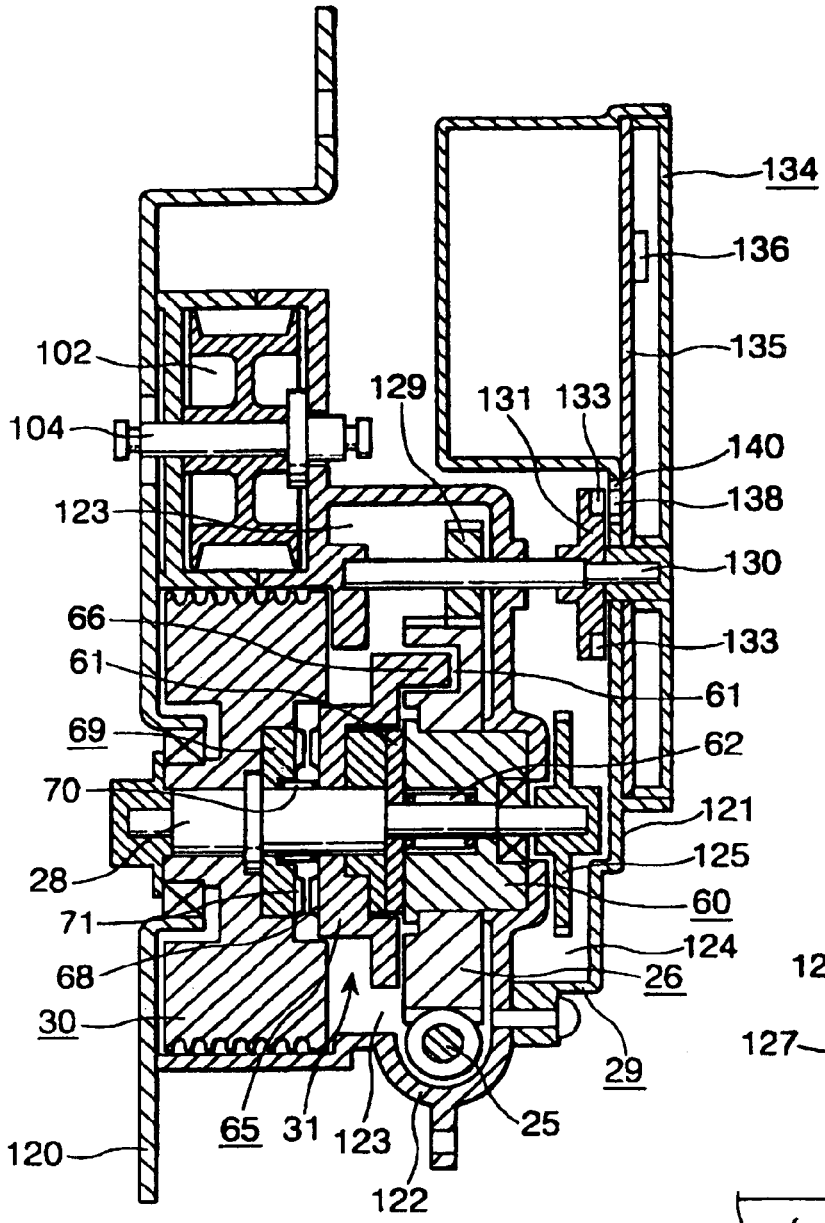
FIG. 6 is a sectional view of the power unit.

As shown in FIGS. 5, 6, a cylindrical worm 25 is mounted on an output shaft of a motor 24 of the power unit 20, and a worm wheel 26 is meshed with the cylindrical worm 25. The worm wheel 26 is pivoted in a housing 29 of the power unit 20 by a support shaft 28, on which the wire drum 30 is also pivoted. Between the worm wheel 26 and the wire drum 30 a clutch mechanism 31 is disposed. When the clutch mechanism 31 is on, the rotation of the worm wheel 26 is transmitted to the wire drum 30, and when turned off, the wire drum 30 is rendered free with respect to the worm wheel 26. Hence, in FIG. 5, when the clutch mechanism 31 is turned on during clockwise rotation of the worm wheel 26 by forward rotation of the motor 24, the wire drum 30 also makes a clockwise rotation, so that the door-opening cable 21A is paid out, and the door-closing cable 21B is wound up. On the contrary, when the clutch mechanism 31 is turned on during counterclockwise rotation of the worm wheel 26 by reverse rotation of the motor 24, the wire drum 30 also makes a counterclockwise rotation, so that the door-opening cable 21A is wound up, and the door-closing cable 21B is pulled out.

The clutch mechanism 31 is irrelevant to the essence of the application of this invention and any type of clutch mechanism may be used. However, for the present application the clutch mechanism described in detail in the U.S. patent application Ser. No. 10/971707 has been applied. The clutch mechanism 31 is such a type of clutch provided with an electromagnetic coil 60 which can be turned on or off through an electric control. Briefly, the clutch mechanism 31 shifts to a clutch connecting state when the electromagnetic coil 60 is turned on and to a clutch disconnecting state when the coil 60 is turned off. Furthermore, as will be described later, the clutch mechanism 31 has a characteristic that a clutch disconnecting state (a brake-clutch connecting state) can be maintained even if the electromagnetic coil 60 has been turned off.

The electromagnetic coil 60 is formed in cylindrical shape and disposed around the support shaft 28. The electromagnetic coil 60 is fixed onto the housing 29 and the support shaft 28 being rotatable with respect to the electromagnetic coil 60. The worm wheel 26 is rotatably supported by the outer periphery of the electromagnetic coil unit 60. As shown in FIG. 6, close to the left of the electromagnetic coil unit 60, there is disposed a circular armature 61. The circular armature 61 is rotatably journaled by the support shaft 28, and moreover, is movable in the shaft direction. The armature 61 is biased toward left away from the electromagnetic coil 60 by a small elastic force of a brake release spring 62 and abuts against a shoulder of the support shaft 28. The right surface of the armature 61 is attracted toward the electromagnetic coil 60 against the elasticity of the brake release spring 62 when the electromagnetic coil 60 is turned on and closely contacts the left surface of the electromagnetic coil 60. Frictional resistance generated through this close contact is caused to be the braking resistance required for clutch connection.

Figure 9:
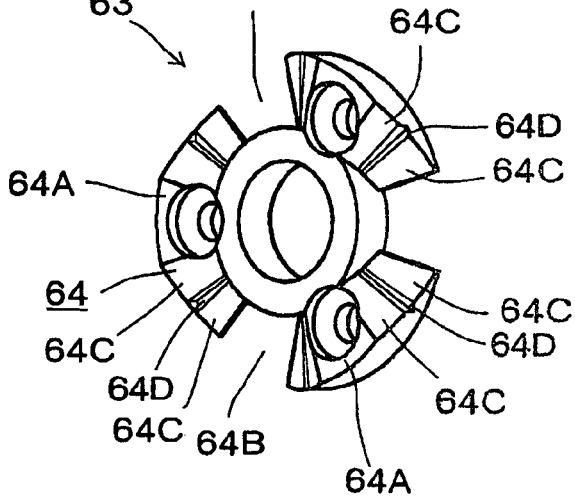
FIG. 9 is a perspective view of a cam member of the power unit.
Figure 11:
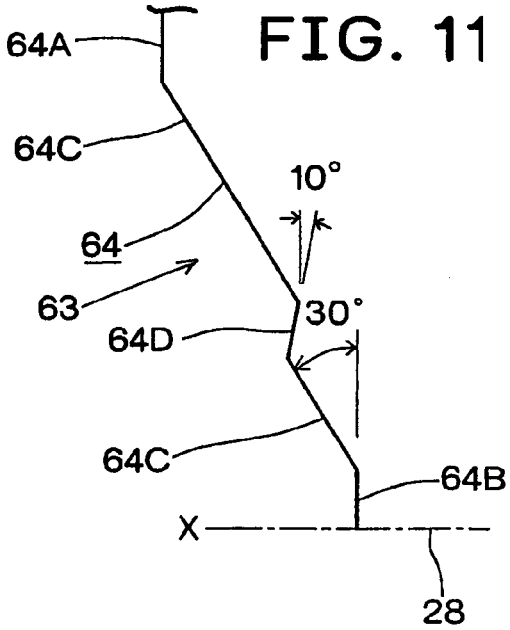
FIG. 11 is a detailed view of a cam face of the cam member.

A cam member 63 (FIG. 9) is secured on the left surface of the armature 61. As the armature 61 and the cam member 63 move together, they may be formed into an integral component. A cam surface 64 of the cam member 63, as shown in FIG. 9, is a disciplined circularly rugged surface which has a top portions 64A protruding leftward in a direction to the shaft center of the support shaft 28, bottom portions 64B formed by notching, and inclined surfaces 64C connecting these portions. The inclined surface 64C is a two step inclined surface comprising a clutch holding surface 64D halfway across its surface. The clutch holding surface 64D halfway across the inclined surface 64C comprises a function to maintain the clutch mechanism 31 in the brake-clutch connecting state when the electromagnetic coil unit 60 is turned off. FIG. 11 shows a detailed shape of the cam surface 64. The cam surface 64C is preferably an inclined surface having about 30 degrees for a shaft center X of the first supply shaft 28, and further, the clutch holding surface 64D is preferably formed in a sweep-back surface having about 10 degrees, though it may be formed in a flat surface orthogonal to the shaft center X.

Figure 10:
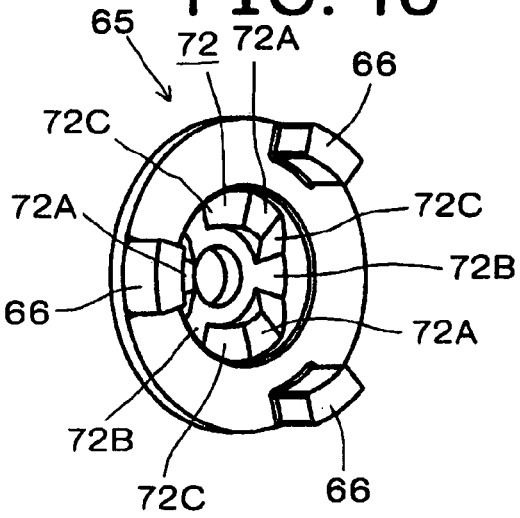
FIG. 10 is a perspective view of a moving gear member of the power unit.
Figure 12:
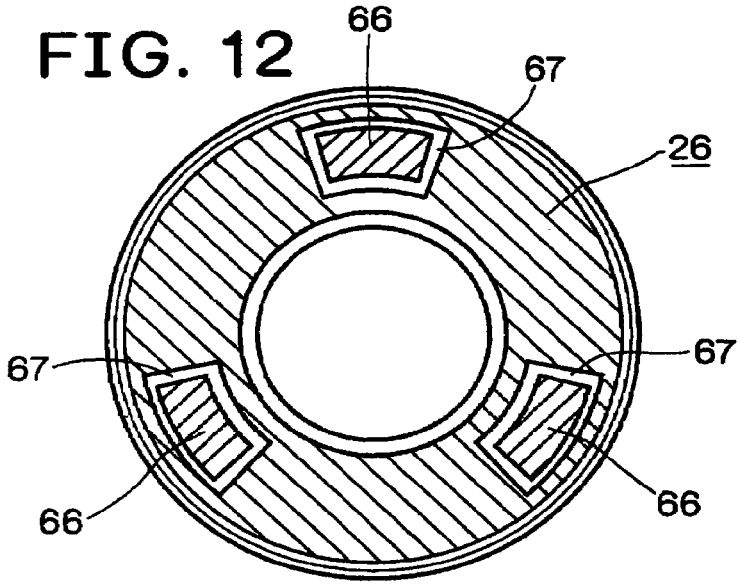
FIG. 12 is a sectional view showing an engaging state between an engaging groove of a first worm wheel and a leg portion of the moving gear member.
Figure 13:
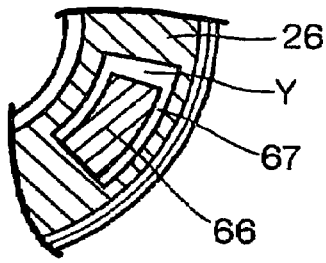
FIG. 13 is an illustration showing a gap between the engaging groove and the leg portion.

In FIG. 6, to the left of the cam member 63, there is provided a moving gear member 65 (FIG. 10). The moving gear member 65 is rotatably and movably journaled to the support shaft 28 in the shaft direction, and its outer periphery is formed with a plurality of leg portions 66 extending toward the right side worm wheel 26. The right side top end portion of the leg portion 66, as shown in FIGS. 6 and 12, is engaged with an engaging groove 67 of the worm wheel 26, and by the rotation of the worm wheel 26, the moving gear member 65 is also rotated in association. While the leg portion 66 is slidable for the engaging groove 67 in the shaft direction of the support shaft 28, even when the moving gear member 65 moves leftward maximum, the engagement between the leg portion 66 and the engaging groove 67 is not released, and consequently, the moving gear member 65 and the worm wheel 26 always integrally rotate. Further, between the leg portion 66 and the engaging groove 67, as shown in FIG. 13, there is formed a gap Y in the rotational direction, and the leg portion 66 (moving gear member 65) is set to be able to freely rotate by approximately six degrees for the engaging groove 67 (worm wheel 26). The left surface of the moving gear member 65 is provided with a moving circular gear portion 68 with the support shaft 28 as a center.

A fixed gear member 69 is provided on left side of the moving gear member 65, and between the moving gear member 65 and the fixed gear member 69, there is provided a clutch releasing spring 70 which presses the moving gear member 65 to the right side. The left surface of the fixed gear member 69 is fixed to the wire drum 30, and both of them integrally rotate. The wire drum 30 is fixed to the left end of the support shaft 28 so as to integrally rotate with the support shaft 28.

A fixed circular gear portion 71 is provided on the right surface of the fixed gear member 69. When the moving gear member 65 slides leftward along the support shaft 28 against the elastic force of the clutch releasing spring 70, the moving circular gear portion 68 engages with the fixed circular gear portion 71. A state in which the gear portion 68 and the gear portion 71 are engaged each other is a normal clutch connecting state of the clutch mechanism 31, and the rotation of the worm wheel 26 is transmitted to the wire drum 30. In contrast to this, when the moving gear member 65 slides rightward for the support shaft 28 by the elastic force of the clutch releasing spring 70, the moving circular gear portion 68 breaks away from the fixed circular gear portion 71, and the clutch is put into a clutch disconnecting state, and the rotation of the worm wheel 26 is not transmitted to the wire drum 30.

As shown in FIG. 10, the moving gear member 65 is formed with a cam surface 72, which slides the moving gear member 65 leftward in cooperation with the cam surface 64 of the cam member 63 against the elastic force of the clutch releasing spring 70. The cam surface 72 is a disciplined circular rugged surface comprising top portions 72A protruding rightward in the shaft center direction of the support shaft 28, bottom portions 72B, and inclined surfaces 72C connecting these portions. The cam surface 72 has a configuration substantially symmetrical to the cam surface 64, however, no clutch holding portion is provided on the cam surface 72 in this embodiment. If provided on either of the cam faces 64, 72, the clutch holding portion causes the effect pursued.

Figure 14:
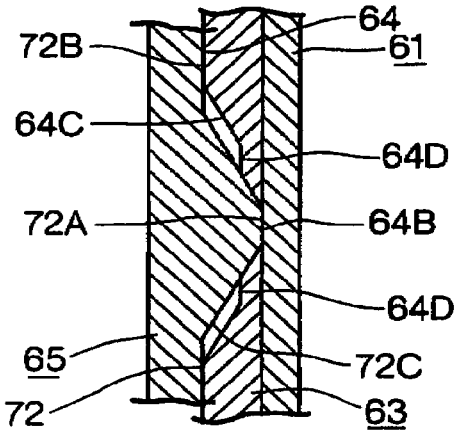
FIG. 14 is a side view showing a cam surface of the cam member and the cam surface of the moving gear member at a clutch disconnecting state.
Figure 15:
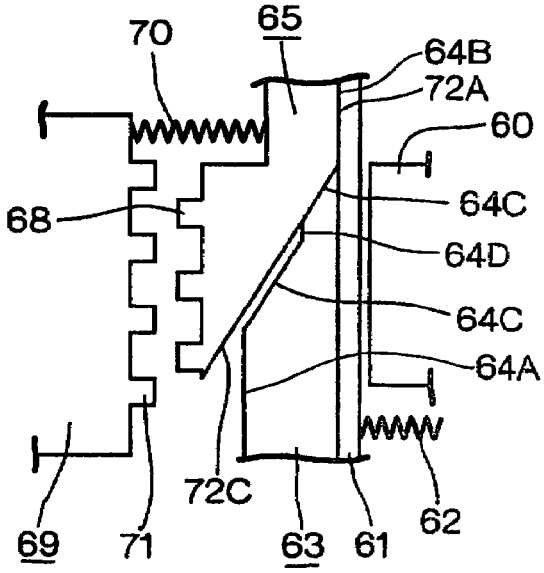
FIG. 15 is a schematic view showing the moving gear member and a fixed gear member at the clutch disconnecting state corresponding to FIG. 14.

When the moving gear member 65 slides rightward by elastic force of the clutch releasing spring 70, normally as shown in FIGS. 14 and 15, the top portion 72A of the cam surface 72 exactly matches the bottom portion 64B of the cam surface 64, and the moving circular gear portion 68 breaks away from the fixed circular gear portion 71, and the clutch mechanism is put into a clutch disconnecting state. In this clutch disconnecting state, when the electromagnetic coil unit 60 is turned on, the armature 61 is pulled and the right surface of the armature 61 is adhered to the left surface (friction surface) of the electromagnetic coil unit 60 by magnetic force against the elastic force of the brake release spring 62, so that the armature 61 and the cam member 63 are given a brake resistance. Subsequently, when the moving gear member 65 (cam surface 72) is rotated by motive power of the motor 24, since the cam member 63 is in a state in which the rotation is controlled by the break resistance, as shown in FIG. 16, the phase between the cam surface 64 of the cam member 63 and the cam surface 72 are shifted due to a wedge effect brought about by the cam surfaces, and the moving gear member 65 is pushed leftward against the elastic force of the clutch releasing spring 70, and as shown in FIG. 17, the moving circular gear portion 68 engages with the fixed circular gear portion 71 so as to be put into a normal clutch connecting state.

Figure 16:
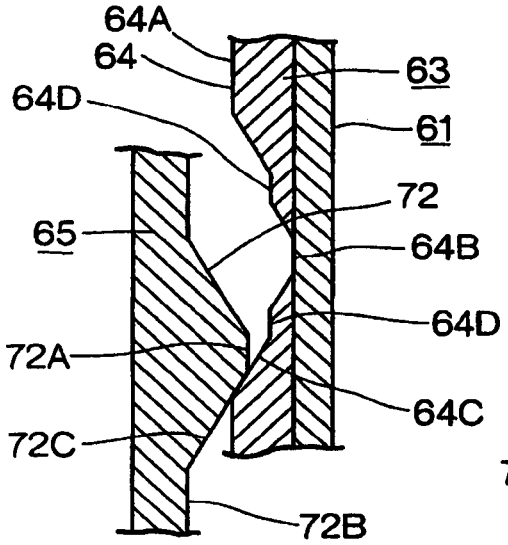
FIG. 16 is a side view showing the cam surface of the cam member and the cam surface of the moving gear member at the clutch connecting state.
Figure 17:
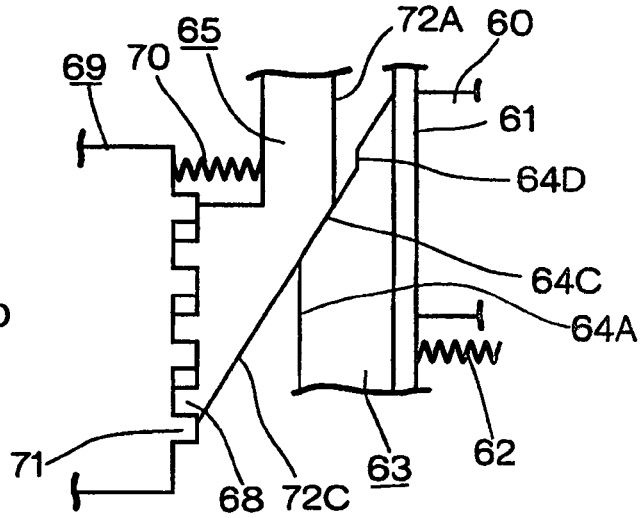
FIG. 17 is a schematic view showing the moving gear member and the fixed gear member at the clutch connecting state corresponding to FIG. 16.
Figure 18:
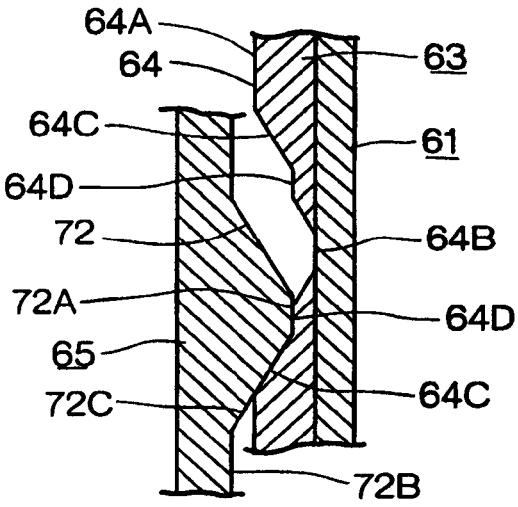
FIG. 18 is a side view showing the cam surface of the cam member and the cam surface of the moving gear member at a brake-clutch connecting state in an off state of an electromagnetic coil unit.
Figure 19:
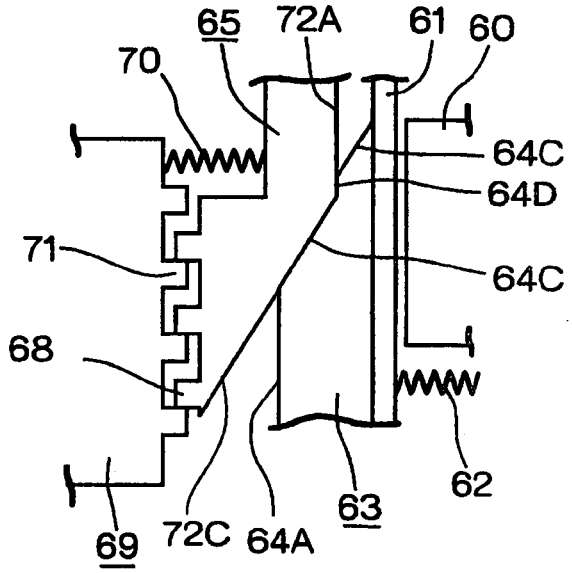
FIG. 19 is a schematic view showing the moving gear member and the fixed gear member of the brake-clutch connecting state corresponding to FIG. 18.
Figure 20:
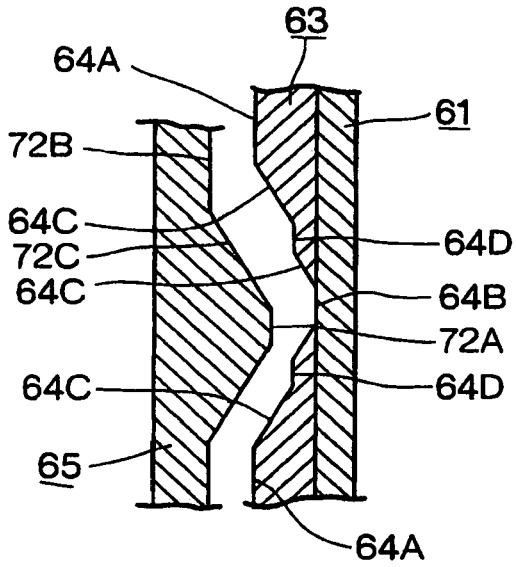
FIG. 20 is a side view showing the cam surface of the cam member and the cam surface of the moving gear member in the midst of releasing the brake-clutch connecting state.
Figure 21:
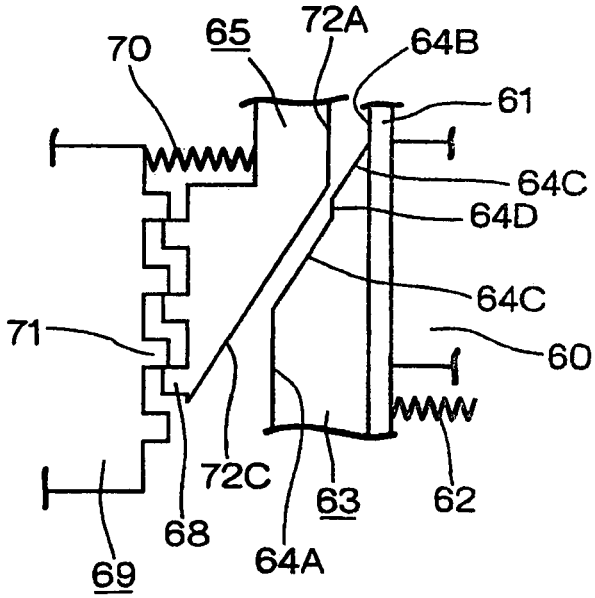
FIG. 21 is a schematic view showing the moving gear member and the fixed gear member in the midst of releasing the clutch connecting state corresponding to FIG. 20.
Figure 22:
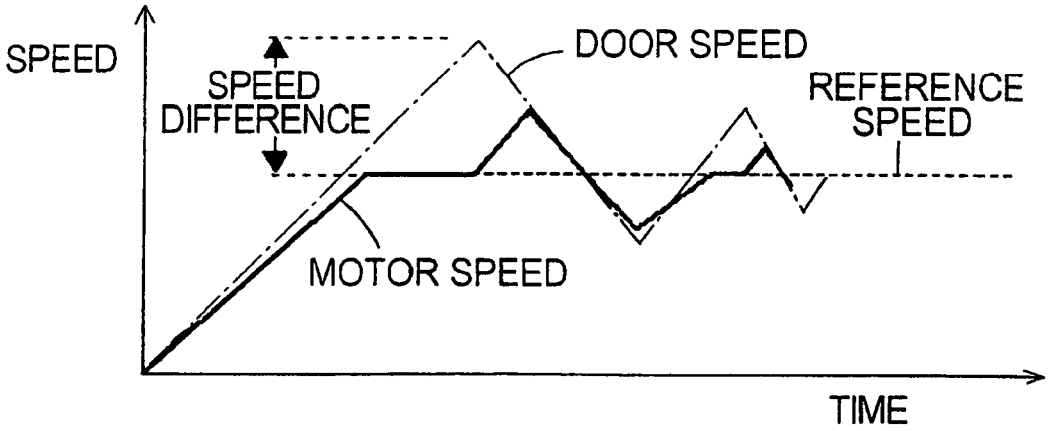
FIG. 22 (PRIOR ART)
FIG. 22 shows the results of measurements of a motor speed and a door speed of a slide door when the slide door was opened under the conventional feedback control based on the motor speed in a nose-up inclined state of the vehicle in accordance with the conventional technology.

When the motor 24 and the electromagnetic coil unit 60 are both turned off in the normal clutch connecting state of FIGS. 16 and 17, the armature 61 and the cam member 63 are released from the brake resistance. Then, by the elastic force of the clutch releasing spring 70, the moving gear member 65 is moved rightward, while rotating the cam member 63 in a flank direction (downward in FIG. 16), and before the moving gear member 65 is disengaged from the fixed gear member 69, as shown in FIGS. 18 and 19, the top portion 72A of the moving gear member 65 abuts against the clutch holding surface 64D of the cam member 63, and in this manner, the moving gear member 65 is unable to rotate the cam member 63, and at the same time, is controlled also in the rightward movement. Hence, even when the electromagnetic coil unit 60 is in an off state, the engagement between the moving gear member 65 and the fixed gear member 69 is maintained, and the clutch mechanism 31 is put into a brake-clutch connecting state.

In the brake-clutch connecting state of FIGS. 18 and 19, due to resistance by the abutment between the top portion 72A and the clutch holding surface 64D, the moving gear member 65 and the armature 61 as well as the cam member 63 are maintained in a state in which they rotate integrally. Consequently, even when the fixed gear member 69 is rotated upward to move the moving gear member 65 upward in FIG. 19, since the armature 61 and the cam member 63 are also associatingly moved upward, the brake-clutch connecting state is not released. Additionally, the frictional force between the top portions 72A and the clutch holding portions 64D to hold the moving gear member 65 and the cam member 63 in an integral state can be secured through forming the clutch holding portions 64D with flat surfaces disposed normal to the axis X of the support shaft 28, however, in case where the clutch holding portions 64D are configured by slant surfaces retarding approximately 10 degrees, preferable magnitude of friction may be ensured.

The abutment of the top portion 72A against the clutch holding portions 64D can be released through moving the moving gear member 65 upward as shown in FIGS. 18, 19 relative to the armature 61 and the cam member 63 after turning on the electromagnetic coil 60 as will be described later in association with a manual operation to release the brake-clutch connecting state. In this case, the rotational angle required for the moving gear member 65 is approximately 5degrees, which is set to be smaller than the free-rotation angle (approximately 6 degrees) for the moving gear member 65 enabled by the gap Y formed between each pair of leg portions 66 and the engaging grooves 67.

The housing 29 comprises a metal base plate 120, a metal or plastic cover plate 121, and a plastic housing body 122 disposed between the plates 120, 121. A first space 123 is defined between the base plate 120 and the body 122, and a second space 124 between the cover plate 121 and the body 122. Within the first space 123 the wire drum 30 and the clutch mechanism 31 are housed.

Figure 7:
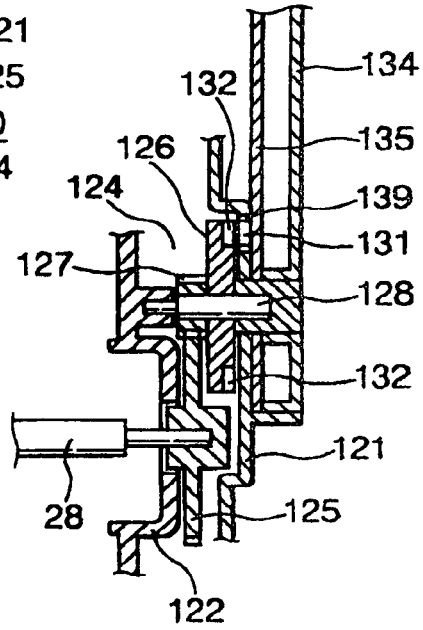
FIG. 7 is a sectional view of the power unit.

As shown in FIGS. 6, 7, one end of the support shaft 28 passes through the housing body 122 and extends into the second space 124, with a large gear 125 being secured to the extended end. A small gear 127 of the drum rotor 126 is meshed with the large gear 125. The drum rotor 126 is pivoted by a shaft 128 disposed in parallel with the support shaft 28 in the second space 124 and rotates together with the rotation of the support shaft 28 rotated by the wire drum 30.

As shown in FIG. 6, a parallel gear 129 is meshed with the worm wheel 26. The parallel gear 129 is disposed on the same plane with the worm wheel 26 in the first space 123. A shaft 130 of the parallel gear 129 is parallel with the supporting shaft 28, and one end of the shaft 130 passes through the housing body 122 and extends into the second space 124, with a motor rotor 131 being fixed to the extended end. The motor rotor 131 is connected to the motor 24 for rotation by way of the worm wheel 26. The motor rotor 131 is disposed so as not to overlap with the drum rotor 126 in the axial direction of the support shaft 28.

A drum rotor element 132 and a motor rotor element 133 both of which are made of a magnetic body are disposed on the drum rotor 126 and the motor rotor 131, respectively.

On an outer surface of the cover plate 121 a control unit 134 is mounted. On a control board 135 of the control unit 134 a control unit 136 is provided, and also a drum speed sensor 137 to detect a rotational speed of the wire drum 30 in cooperation with the drum rotor element 132 and a motor speed sensor 138 to detect a rotational speed of the motor 24 in cooperation with the motor rotor element 133 are disposed. The sensors 137, 138 are Hall effect IC, and are disposed so as to be able to detect the rotational elements 132, 133 through windows 139, 140 formed on the cover plate 121. Also, if the sensors 137, 138 extending toward the control board 135 are disposed within the windows 139, 140, the control board 135 may snuggly fit on the cover plate 121 and distances between the sensors 137, 138 and the rotational elements 132, 133 may be reduced.

(Operation of Clutch)

Now, operation of the clutch mechanism 31 will be explained. When the electromagnetic coil 60 is off substantially no frictional resistance may be generated between the armature 61 and the electromagnetic coil 60. Under this state, if the cylindrical worm 25 is rotated by the motor 24 rotating in a forward direction the worm wheel 26 rotates clockwise in FIG. 5, and the moving gear member 65 also rotates clockwise due to the engagement of the leg portions 66 with the engaging grooves 67. In this case, the moving gear member 65 is shifted to the right by the elasticity of the clutch releasing spring 70, and the moving circular gear portion 68 of the moving gear member 65 is disengaged from the fixed circular gear portion 71 of the fixed gear member 69 (in the clutch disconnecting state) as shown in FIGS. 6, 15, and further the cam surface 72 of the moving gear member 65 is in contact with the cam surface 64 of the cam member 63 as shown in FIG. 14. As a result, if the motor 24 is rotated in the forward direction under this state, the moving gear member 65, the cam member 63, and the armature 61 attached to the cam member 63 simply rotate integrally resulting in no displacement of the moving gear member 65 toward the fixed gear member 69.

Under the above state (FIGS. 14, 15), if the electromagnetic coil 60 is turned on, the armature 61 is attracted by a generated magnetic force toward the electromagnetic coil 60 against the resilience of the brake release spring 62 and a predetermined magnitude of braking resistance is generated between the electromagnetic coil 60 and the armature 61. As a result, the integral rotation of the armature 61 and the cam member 63 against the moving gear member 65 is restricted, and the moving gear member 65 rotates about the support shaft 28 relative to the cam member 63. Then, the phase between the cam surfaces 64, 72 shifts as shown in FIG. 16, and the moving gear member 65 is pushed out toward the fixed gear member 69 against the resilience of the clutch releasing spring 70, and then the moving circular gear portion 68 of the moving gear member 65 engages the fixed circular gear portion 71 of the fixed gear member 69 to bring about the normal clutch connecting state. Consequently, the rotation of the motor 24 may be transmitted to the wire drum 30 by way of the fixed gear member 69 for winding the closing cable 21B to move the slide door 11 toward the door-closing direction. After the clutch engagement, both the armature 61 and the cam member 63 rotate integrally with the moving gear member 65.

If both the motor 24 and the electromagnetic coil 60 are turned off while the slide door 11 is moving in the door-closing direction, the moving gear member 65 engaged with the worm wheel 26 stops its rotation, and the armature 61 and the cam member 63 are released from the braking resistance, and the moving gear member 65 is returned toward the right by the elastic force of the clutch releasing spring 70 while rotating the cam member 63 in the release direction (downward in FIGS. 16, 17). Then, prior to the disengagement of the moving gear member 65 from the fixed gear member 69, the top portion 72A of the moving gear member 65 abuts against the clutch holding portions 64D of the cam member 63 as shown in FIGS. 18, 19, whereby the moving gear member 65 is unable to rotate the cam member 63, and at the same time, the rightward movement of gear member 65 is restricted. As a result, even if the electromagnetic coil 60 is off, the engagement of the moving gear member 65 with the fixed gear member 69 is maintained and the clutch mechanism 31 is brought into the brake-clutch connecting state. Under the brake-clutch connecting state, being directly connected to a speed reduction mechanism on the side of the motor 24, the slide door 11 is maintained in a state substantially of no move. Consequently,. if a user turns the motor 24 and the electromagnetic coil 60 off intentionally, the slide door 11 can be held at a desired semi-door-open position. Also, if this intermediate stopping is devised to be performed by the control unit 136, a semi-door-open state of the slide door 11 may be attained easily and automatically.

When the slide door 11 has moved to the door-closed position with normal closing control executed by the control unit 136 (in this case the clutch mechanism 31 is in the normal clutch connecting state as shown in FIGS. 16, 17), the motor 24 is rotated in a reverse direction for a predetermined time (predetermined rotation). Then, as the electromagnetic coil 60 is kept in the activated state the moving gear member 65 alone moves upward in FIG. 17 by a predetermined distance leaving the armature 61 and the cam member 63 behind, and further the top portion 72A of the moving gear member 65 shifts upward away from the clutch holding portions 64D of the cam member 63. When this state is attained, the electromagnetic coil 60 and the motor 24 are turned off. By this operation, the top portion 72A of the moving gear member 65 moves rightward by the elastic force of the clutch releasing spring 70 without contacting the clutch holding portions 64D of the cam member 63 to resume the clutch disconnecting state of FIGS. 14 and 15.

Now, a method to release the brake-clutch connecting state (FIGS. 18, 19) of the clutch mechanism 31 will be explained. For changing the brake-clutch connecting state to the clutch disconnecting state, the electromagnetic coil 60 is turned on at first. Then, the armature 61 and the cam member 63 are attracted toward the electromagnetic coil 60 for generation of braking resistance. At this stage, though the moving gear member 65 also slightly moves rightward by the elastic force of the clutch releasing spring 70, the engagement with the fixed gear member 69 still continues. Next, in the case of the motive power, the motor 24 is rotated, and the moving gear member 65 is rotated upward in the case of FIG. 19, and when the top portion 72A of the moving gear member 65 moves upper than the clutch holding surface 64D of the cam member 63, the electromagnetic coil unit 60 and the motor 24 are turned off. As a result, the top portions 72A of the moving gear member 65 move rightward without contacting the clutch holding portions 64D of the cam member 63 by the resilience of the clutch releasing spring 70, and the clutch returns to the clutch disconnecting state as shown in FIGS. 14, 15.

In case the brake-clutch connecting state is to be released manually instead of the motive power of the motor 24, after the electromagnetic coil unit 60 is turned on, the slide door 11 is manually moved. Then, the wire drum 30 is rotated, and the moving gear member 65 is also rotated through the fixed gear member 69. At this time, in the brake-clutch connecting state, though the wire drum 30 is connected to the motor 24 side, since the gap Y formed between the leg portion 66 and the engaging groove 67 allows the moving gear member 65 to freely rotate approximately six degrees for the worm wheel 26, the slide door 11 moves by slight operational force without rotating the worm wheel 26, and can rotate the moving gear member 65. Subsequently, by the rotation of the moving gear member 65, when the top portion 72A of the moving gear member 65 comes off from the clutch holding surface 64D of the cam member 63, the moving gear member 65 moves rightward by the elastic force of the clutch releasing spring 70, and the clutch returns to the clutch disconnecting state of FIGS. 14 and 15.

Under the manual release of the brake-clutch connecting state as described above, the control unit 136 outputs a signal for turning on the electromagnetic coil 60 for a give time when it detects a manual operation for clutch disengagement. Various kinds of operations may be employed for determining the manual operation for clutch disengagement; for example, a movement of a door open handle of the slide door 11 by a manual door opening operation can be a typical signal of the manual operation for clutch disengagement.

(Operation for Speed Control by the CONTROL UNIT 136)

A travel distance of the slide door 11 driven by the power unit 20 is divided roughly into three sections, i.e., an initial section from the start to a completion of acceleration, an intermediate section of substantially a constant speed, and a deceleration section as a final section. Also, in the initial section a slow speed section extending for a given time may be provided, if required.

When the slide door 11 is opened from the closed position (or closed from the open position) by the power unit 20, the motor 24 is rotated at a slow speed for a given time as may be desired, and after that the motor 24 is accelerated for a predetermined reference speed. The control unit 136 monitors the movement of the slide door 11 in this initial section to detect abnormal accelerations. Preferably, the sliding door 11 is determined to be under abnormal acceleration, when a rotational speed of the wire drum 30 measured by the drum speed sensor 137 is above a given value (of and above 120 mm/sec. on sliding speed equivalent), a difference between the rotational speed of the wire drum 30 and a rotational speed of the motor 24 measured by the motor speed sensor 138 is above a given value (of and above 400 mm/sec. on sliding speed equivalent), and acceleration of the wire drum 30 is above a given value. Also, it is preferable to determine that the sliding door 11 is under abnormal acceleration, when a rotational speed of the wire drum 30 is above a given value (of and above 120 mm/sec. on sliding speed equivalent), a difference between the rotational speed of the wire drum 30 and a rotational speed of the motor 24 is above a given value (of and above 180 mm/sec. on sliding speed equivalent), and the difference of and above a given value has been detected consecutively.

Such abnormal acceleration as described above may be caused when the sliding door 11 is in a state to receive an external force for accelerating the door. For example, the vehicle body 10 is in an inclined state, or the slide door 11 is received a manual operating force by the user. In other words, according to this invention the inclination of the vehicle body 10 can be estimated based on the results of comparison of the motor speed and the drum speed.

When the abnormal acceleration has been detected, the control unit 136 lowers a rotational speed of the motor 24 to stabilize a sliding speed of the slide door 11, and then accelerate the motor 24 again toward the reference speed. This re-acceleration of the motor 24 is preferable to be performed at a lower rate of acceleration than the initial rate.

When the control over the slide door 11 is implemented through detecting the abnormal acceleration as described above, the difference between the motor speed and the door speed of the slide door 11 in the initial section will substantially be reduced in comparison with the prior art, and as result, the slide door 11 may be traveled smoothly at a stable speed.

(Advantages)

In accordance with this invention, when the slide door 11 is slid by the power unit 20, the abnormal accelerations in the initial section from the start to the completion of acceleration can be detected by utilizing the drum speed and the motor speed. And the control unit 136 lowers a rotational speed of the motor 24 to stabilize the actual door speed of the slide door 11 when the abnormal acceleration is detected, and then the motor 24 is accelerated (preferably at a smaller rate of acceleration) again toward the reference speed. Thus, the difference between the motor speed and the door speed of the slide door 11 at the end of the initial section can be reduced substantially relative to the prior art, whereby the difference between the door speed and the motor speed brought about by the connection looseness can be reduced to enable the slide door 11 travel smoothly at a stable speed.

Also, in accordance with this invention, the wire drum 30, the clutch mechanism 31, the drum rotor 126, and the motor rotor 131 are installed within the housing 29, and the shaft 128 of the drum rotor 126 and the shaft 130 of the motor rotor 131 are disposed in parallel to the support shaft 28 of the wire drum 30. Accordingly, the drum rotor 126 and the motor rotor 131 can be mounted rationally within the housing. In addition, as the control board 135 having the control unit 136 which performs control of the motor 24 is attached to the outer surface of the cover plate 121 of the housing 29, and the drum speed sensor 137 and the motor speed sensor 138 are disposed on the control board 135, rational placing of the sensors 137, 138 can be materialized.

Furthermore, as the drum speed sensor 137 and the motor speed sensor 138 are disposed in the windows 139, 140 formed on the cover plate 121, the control board 135 can be fit snuggly to the cover plate 121 and also distances between the sensors 137, 138 and the rotational elements 132, 133 can be reduced.

In addition, as the drum rotor 126 is configured to rotate together with the wire drum 30 by way of the support shaft 28, and the motor rotor 131 is configured to rotate together with the motor 24 by way of the worm wheel 26 rotated by the motor 24, the drum rotor 126 can accurately reflect rotation of the wire drum 30 and similarly the motor rotor 131 can accurately reflect rotation of the motor 24, whereby accuracy of measurements can be expected to enhance.

Finally, as the drum rotor 126 and the motor rotor 131 can be disposed so as to avoid overlap in an axial direction of the support shaft 28, any enlargement of the housing 29 can be restrained.

What is claimed is:

1. A method to control a power slide device comprising a motor, a wire drum for moving a slide door slidably mounted on a vehicle body in a door-opening direction or in a door-closing direction when rotated, a clutch mechanism disposed between the motor and the wire drum, a drum speed sensor for detecting a rotational speed of the wire drum, and a motor speed sensor for detecting a rotational speed of the motor, said method comprising the steps of:

accelerating the motor initially for a predetermined reference speed;

during the initial acceleration period, judging that the slide door is in a state of abnormal acceleration when a rotational speed of the wire drum measured by the drum speed sensor is of and above a given value and a difference between a rotational speed of the wire drum and a rotational speed of the motor measured by the motor speed sensor is of and above a given value, and reducing a rotational speed of the motor temporarily; and after that, accelerating the motor again for the reference speed.

2. The method to control a power slide device in accordance with claim 1, wherein the motor is accelerated at a lower rate in comparison with the initial acceleration employed under a normal state when the motor is accelerated again.

3. The method to control a power slide device in accordance with claim 1, wherein a condition that a rate of acceleration of the wire drum is of and above a given value is added in judging whether the slide door is in the abnormal acceleration or not.

4. The method to control a power slide device in accordance with claim 3, wherein the motor is accelerated at a lower rate in comparison with the initial acceleration employed under a normal state when the motor is accelerated again.

5. A method to control a power slide, device comprising a motor, a wire drum for moving a slide door slidably mounted on a vehicle body in a door-opening direction or in a door-closing direction when rotated, a clutch mechanism disposed between the motor and the wire drum, a drum speed sensor for detecting a rotational speed of the wire drum, and a motor speed sensor for detecting a rotational speed of the motor said method comprising the steps of:

accelerating the motor initially for a predetermined reference speed;

during the initial acceleration period, judging that the slide door is in a state of abnormal acceleration when a rotational speed of the wire drum measured by the drum speed sensor is of and above a given value and a difference between a rotational speed of the wire drum and a rotational speed of the motor measured by the motor speed sensor is of and above a given value and the difference of and above the given value has been detected consecutively, and reducing a rotational speed of the motor temporarily; and after that accelerating the motor again for the reference speed.

6. The method to control a power slide device in accordance with claim 5, wherein the motor is accelerated at a lower rate in comparison with the initial acceleration employed under a normal state when the motor is accelerated again.

* * * * *